US006371538B1

(12) United States Patent
Inoue

(10) Patent No.: US 6,371,538 B1
(45) Date of Patent: Apr. 16, 2002

(54) VEHICLE DOOR LATCH DEVICE WITH BLOCK TYPE ANTI-THEFT MECHANISM

(75) Inventor: Jiro Inoue, Yamanashi-ken (JP)

(73) Assignee: Mitsui Kinzoku Kogyo Kabushiki Kaisha, Tokyo (JP)

( * ) Notice: Subject to any disclaimer, the term of this patent is extended or adjusted under 35 U.S.C. 154(b) by 55 days.

(21) Appl. No.: 09/635,077

(22) Filed: Aug. 9, 2000

(51) Int. Cl.[7] ..... E05C 3/12
(52) U.S. Cl. ..... 292/216; 292/201; 292/DIG. 23
(58) Field of Search ..... 292/201, 216, 292/DIG. 23

(56) References Cited

U.S. PATENT DOCUMENTS 5,071,178 A * 12/1991 Brackman et al. ..... 292/216
5,865,481 A * 2/1999 Buschmann ..... 292/216
5,896,767 A * 4/1999 Gomi ..... 292/216
5,961,164 A * 10/1999 Gomi ..... 292/216

* cited by examiner

*Primary Examiner*—Teri Pham Luu
(74) *Attorney, Agent, or Firm*—Browdy & Neimark

(57) ABSTRACT

A vehicle door latch device comprises a block member (66) displaceable between a blocking position (B) for restricting a displacement of a lock lever (23) to an unlocked position (UL) by a mechanical engagement with the lock lever (23) and an unblocking position (UB), a connecting lever (72) connected to an inside lock button (36) with no substantial lost-motion, and a connecting spring (73) for connecting the connecting lever (72) and the lock lever (23). The connecting lever (72) is substantially displaceable integrally with the lock lever (23) by an action of the connecting spring (73) when the block member (66) is located at the unblocking position (UB). The connecting lever (72) is displaced with respect to the lock lever (23) against a spring force of the connecting spring (73) when the unlocking operation of the inside lock button (36) is carried out at a state where the block member (66) is located at the blocking position (B).

8 Claims, 8 Drawing Sheets

22
16
35A
35D
32
37
33
31
24
41
34
35
8
35B
21
35C
27
UL
30
L
23
41A
23A 22
16
35A
35D
37
33
32
31
41
34
8
35
35B
21
35C
24
23
UL
27
30
L
41A
23A

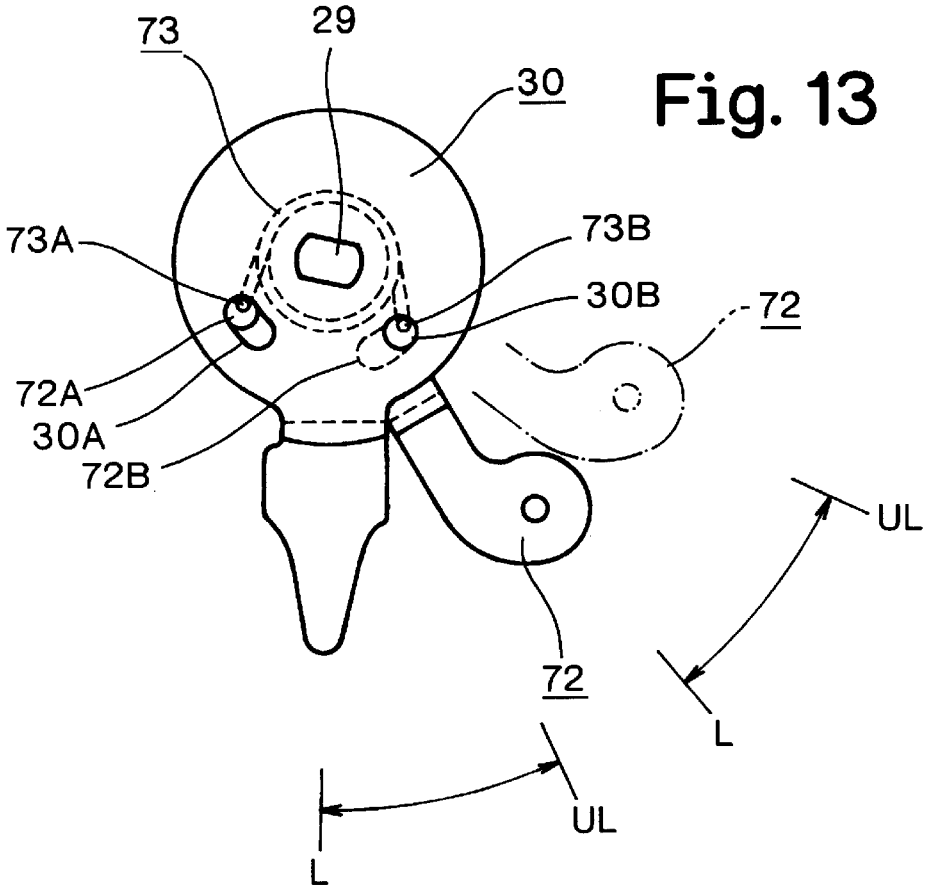
Fig. 13
Fig. 14
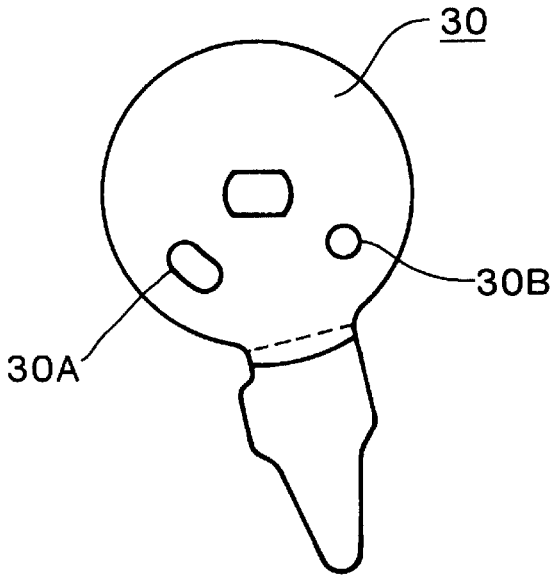
Fig. 15
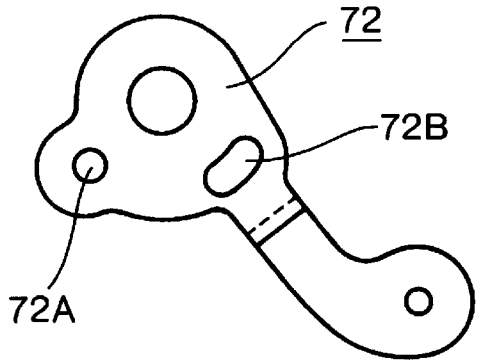

VEHICLE DOOR LATCH DEVICE WITH BLOCK TYPE ANTI-THEFT MECHANISM

BACKGROUND OF THE INVENTION

1. Field of the Invention

The present invention relates generally to a vehicle door latch device, and more particularly to a vehicle door latch device with a block type anti-theft mechanism.

2. Prior Art

A conventional door latch device includes a lock lever which is displaceable, by unlocking and locking operations of an inside lock button of the door, between an unlocked position where it makes a door-opening operation of the outside open handle effective and a locked position where it makes the door-opening operation of the outside open handle ineffective. Because the inside lock button to which the lock lever should be connected is exposed on an interior surface of the door, the lock button does not have so high an anti-theft performance. For example, it is very easy to operate the lock button by breaking a door glass from outside the vehicle to illegally change the lock lever to the unlocked position. To invalidate such an illegal access to the lock button, a number of anti-theft mechanisms have been developed.

The anti-theft mechanism is classified to two types depending on its structure. One of them is a type containing a free-play mechanism provided between the inside lock button and the lock lever. The free-play mechanism can absorb an unlocking movement of the lock button so as not to transmit the unlocking movement to the lock lever. That is, no force is applied to the lock lever even if the lock button is operated to unlock. This free-play mechanism effectively invalidates the illegal access to the inside lock button. However, the free-play type anti-theft mechanism is not capable of preventing an illegal access to the lock lever by means of a special tool which is inserted into a gap between a door frame and a door glass. That is, although the free-play type anti-theft mechanism is capable of improving anti-theft performance of the inside lock button, it is not capable of improving the anti-theft performance of the lock lever.

Another anti-theft mechanism is a type having a block member which makes the lock lever immovable. The block member comes into contact with the lock lever mechanically so as to restrict a displacement of the lock lever from the locked position to the unlocked position. This block type anti-theft mechanism is capable of improving both the anti-theft performances of the lock lever and the lock button.

The above-mentioned block type anti-theft mechanism has some disadvantages. A first disadvantages is that the block member is not protected from the illegal access. Thus, after the mechanical contact between the block member and the lock lever is released by a first illegal access against the block member, the lock lever may be offended by a second illegal access.

A second disadvantage is that the block type anti-theft mechanism requires the door latch device to have a high strength. Because, in the block type anti-theft mechanism, an external force applied to the inside lock button by the illegal access is transmitted to the lock lever, the components such as a lock lever, lock button, and block member must have a strength resisting the external force generated by the powerful illegal access. This increases weight and size of components.

A third disadvantage is that the block type anti-theft mechanism does not go well with the well known one-motion door opening mechanism which carries out restoration of the lock lever from the locked position to the unlocked position and opening of the door substantially at the same time, by an opening operation of an inside open handle of the door. The door latch device with the one-motion door opening mechanism transmits an opening movement of the inside open handle to the lock lever located at the locked position in order to displace the lock lever to the unlocked position. However, because the block type anti-theft mechanism is a mechanism for restricting the displacement of the lock lever from the locked position to the unlocked position, a large load is applied to parts such as the lock lever and block member if the opening movement of the inside open handle is transmitted to the lock lever through the one-motion door opening mechanism. Therefore, according to the prior art device, when the block type anti-theft mechanism and the one-motion door opening mechanism are installed in the latch device at the same time, a sufficient strength needs to be secured for the above-mentioned parts not to be deformed by a strong operating force of the inside open handle.

SUMMARY OF THE INVENTION

Accordingly, an object of the present invention is to provide a vehicle door latch device with the block type anti-theft mechanism which overcomes the above-mentioned disadvantages.

BRIEF DESCRIPTION OF THE DRAWINGS

FIG. 13 is a side view showing the outer output lever of the actuator and the connecting lever;

FIG. 14 is a side view of the outer output lever; and

FIG. 15 is a side view of the connecting lever.

DESCRIPTION OF THE PREFERRED EMBODIMENTS

Figure 1:
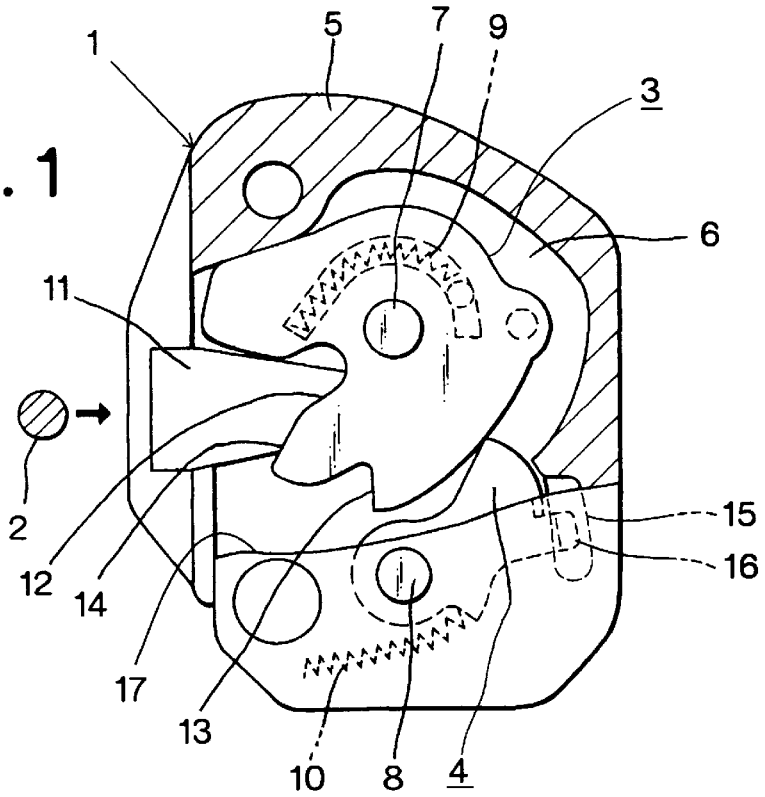
FIG. 1 is a front view of a latch assembly of a door latch device of the present invention.

A preferred embodiment of the vehicle door latch device of the present invention will be described with reference to the accompanying drawings. The door latch device comprises a latch assembly 1 to be mounted on a door (not shown) and a striker 2 fixed to a vehicle body (not shown).

The latch assembly 1 comprises a latch 3 which engages the striker 2 when the door is closed, and a ratchet 4 for holding an engagement between the latch 3 and the striker 2. The latch 3 is accommodated rotatably by a latch shaft 7 in a concave portion 6 formed in a front surface of a synthetic resin latch body 5, and the ratchet 4 is accommodated rotatably by a ratchet shaft 8 in the concave portion 6.

The latch 3 is urged clockwise in FIG. 1 by an elastic force of a latch spring 9 and the ratchet 4 is urged counterclockwise by an elastic force of a ratchet spring 10. In FIG. 1, the latch 3 is located at an unlatched position or open position by an elastic force of the latch spring 9. When the door is moved to a closed position, the striker 2 advances into a horizontal aisle 11 formed in the latch body 5 to be brought into contact with a U-shaped groove 12 of the latch 3, thereby the latch 3 is turned counterclockwise against the spring force of the latch spring 9. When the latch 3 is rotated up to a half-latched position, the ratchet 4 is engaged with a first step 13 of the latch 3 and the door reaches a half-closed position. Further, when the latch 3 reaches a full-latched position, the ratchet 4 is engaged with a second step 14 of the latch 3 and the door is held in a full-closed position.

The ratchet 4 has a ratchet pin 16 which is protruded to a rear side of the latch body 5 through an opening 15 of the latch body 5. A metallic cover plate 17 for substantially shutting the concave portion 6 is fixed on the front surface of the latch body 5. The cover plate 17 is partially indicated in FIG. 1.

Figure 2:
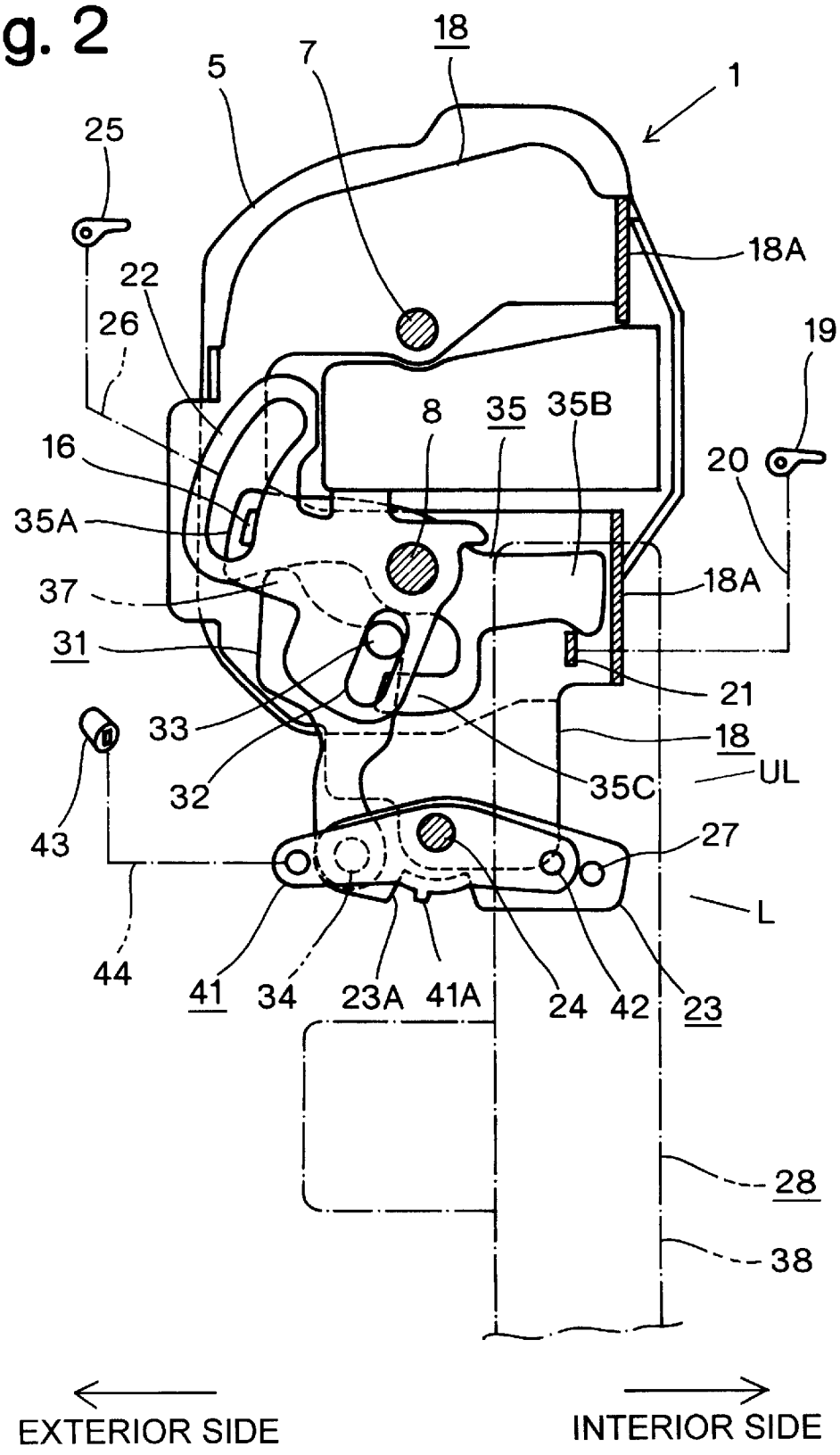
FIG. 2 is a rear view of the latch assembly in a locked state.

As shown in FIG. 2, a metallic back plate 18 is fixed on a rear side of the latch body 5. The back plate 18 is formed integrally with a bent plate 18A which is angled to extend backward from an interior side of the plate 18. An inner lever 21 (see FIGS. 3, 4) is rotatably mounted on the bent plate 18A. The lever 21 is connected to an inside open handle 19 of the door through a wire 20 or the like.

The latch assembly 1 has an open lever 22 for opening the door by releasing the ratchet 4 from the latch 3, and a lock lever 23 for changing over the latch assembly 1 between a locked state and an unlocked state. The open lever 22 is rotatably mounted on a rear side of the latch body 5 by the ratchet shaft 8. An exterior side end of the open lever 22 is connected, with a lost-motion, to an end of a rod 26 which is connected to an outside open handle 25. The lock lever 23 is rotatably mounted on the latch body 5 or the back plate 18 through a lock shaft 24. A connecting hole 27 is formed in an interior side portion of the lock lever 23.

A motorized actuator 28 with a block type anti-theft mechanism is fixed on the bent plate 18A. The actuator 28 is entirely covered with a synthetic resin case or housing 38. The actuator 28 has two shafts, namely an output shaft 29 and an input shaft 39, which are protruded outward through the case 38. The output shaft 29 is protruded from the case 38 toward the interior side. A protruding portion of the output shaft 29 supports an outer output lever 30 (FIG. 14), and a tip end of the output lever 30 engages the connecting hole 27 in the lock lever 23. Consequently, the lock lever 23 can be displaced between the unlocked position UL and locked position L by actuation of the actuator 28.

A lock link 31 is provided between the lock lever 23 and the open lever 22. The lock link 31 has a lock pin 33 which is slidably engaged with an elongated slot 32 formed in the open lever 22. The lock link 31 is connected to the lock lever 23 through a shaft 34.

A ratchet lever 35 is journaled by the ratchet shaft 8. The ratchet lever 35 is located between the latch body 5 and the open lever 22. An outer arm 35A of the ratchet lever 35 which extends to the exterior side is engaged with the ratchet pin 16 extended backward from the ratchet 4, so that the ratchet lever 35 is rotated integrally with the ratchet 4. An inner arm 35B of the ratchet lever 35 which extends to the interior side is positioned on a rotation trajectory of the inner lever 21 when the inner lever 21 is rotated by the opening operation of the inside open handle 19, the ratchet lever 35 is rotated counterclockwise in FIGS. 2, 5 by a contact with the inner lever 21, and the ratchet 4 is then rotated through the ratchet pin 16 to be disengaged from the latch 3, thereby the door is opened.

Figure 5:
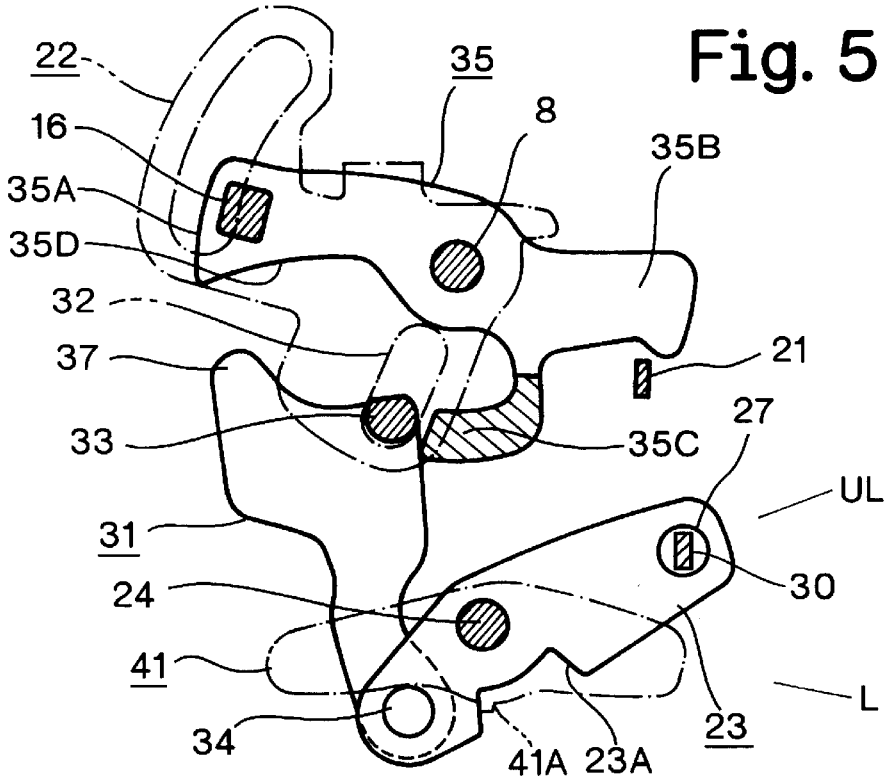
FIG. 5 is a rear view showing levers in an unlocked state.

The lock lever 23 is changed over between the unlocked position UL (FIG. 5) and the locked position L (FIG. 6) by actuation of the actuator 28, a well known inside lock button 36 (FIG. 3) and a well known door key cylinder 43 of the door. If the lock lever 23 is located at the unlocked position UL as shown in FIG. 5, the lock pin 33 is engageably opposed to a contact arm 35C of the ratchet lever 35. In this unlocked state, when the open lever 22 is rotated counterclockwise by the opening operation of the outside open handle 25, the lock pin 33 comes into contact with the contact arm 35C so as to rotate the ratchet lever 35 counterclockwise, thereby the door is opened.

Figure 6:
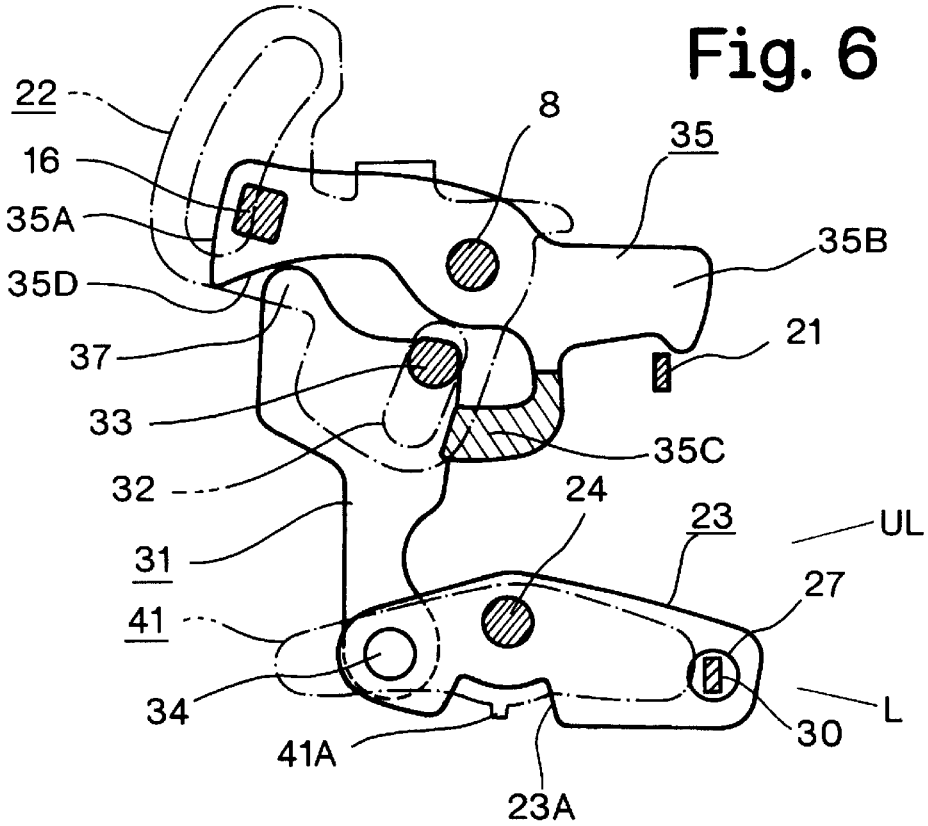
FIG. 6 is a rear view showing levers in the locked state.

In FIG. 5, when turning the lock lever 23 clockwise toward the locked position L, the lock link 31 is moved upward as shown in FIG. 6, and the engageable state between the lock pin 33 and the contact arm 35C is then released. In this locked state, Even if the open lever 22 is rotated counterclockwise by the outside open handle 25, the ratchet lever 35 cannot be rotated, so that the door is not opened. However, if the inside open handle 19 is operated, in FIG. 6, for opening the door, the inner lever 21 comes into contact with the inner arm 35B of the ratchet lever 35 so as to rotate the ratchet lever 35, and thereby the door is opened. As described above, the opening operation of the inside open handle 19 is validated even if the lock lever 23 is located at the locked position L.

The lock link 31 has a protrusion 37 which extends toward a lower surface 35D of the outer arm 35A of the ratchet lever 35. The protrusion 37 is located near the lower surface 35D in the locked state shown in FIG. 6. Thus, when turning the ratchet lever 35 counterclockwise by the door-opening operation of the inside open handle 19 under the locked state, the lower surface 35D comes into contact with the protrusion 37 so as to move the lock link 31 downward, so that the lock lever 23 is restored to the unlocked position UL. Accordingly, the door-opening operation of the inside open handle 19 under the locked state is approximately simultaneously capable of restoring the lock lever 23 to the unlocked position UL and opening the door. This mechanism is called "one-motion door opening mechanism" of the inside open handle 19.

The input shaft 39 of the actuator 28 is protruded to the exterior side from the case 38 of the actuator 28. An protruding portion of the input shaft 39 supports an outside input lever 40 which is engaged with an engagement pin 42 provided at an interior side end of a key lever 41. The key lever 41 is rotatably mounted on the lock shaft 24 and connected to a key cylinder 43 of the door via a rod 44. The key lever 41 has a bent piece 41A which is engaged with a concave portion 23A formed in the lock lever 23 with a lost-motion, so that the lock lever 23 is changed over between the unlocked position UL and the locked position L by a rotation of the key lever 41. The key cylinder 43 is held at its neutral position by an elastic force of a spring (not shown) provided at the key cylinder when it is not subjected to a key operation.

Figure 7:
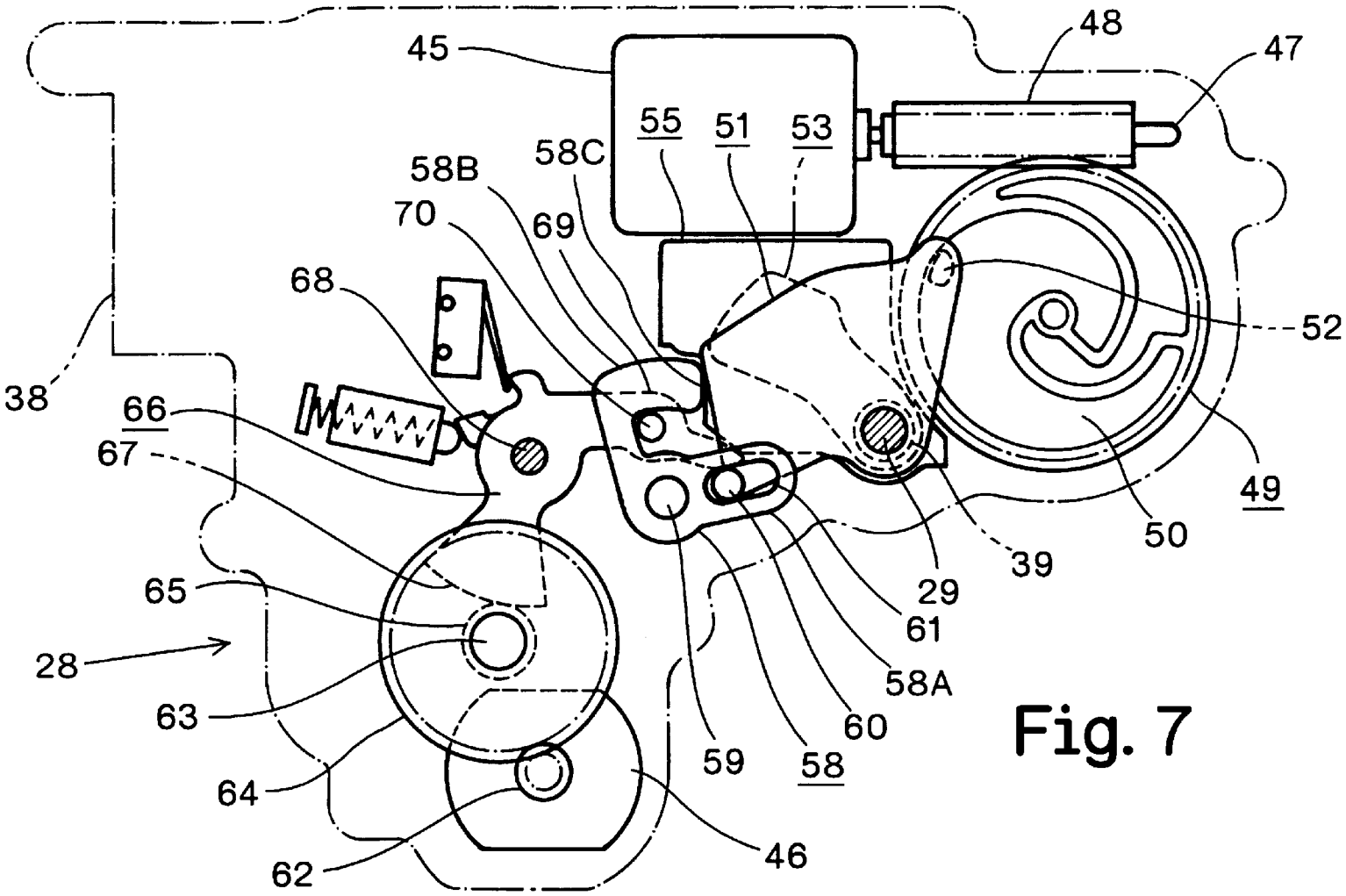
FIG. 7 is a view showing an interior of an actuator of the latch assembly in the unlocked state.

As shown in FIG. 7, the case 38 of the actuator 28 accommodates two motors 45, 46 as shown in FIG. 7. The lock motor 45 has a motor shaft 47 to which a cylindrical worm 48 is fixed. The cylindrical worm 48 is meshed with an external peripheral gear portion of a cam wheel 49. The cam wheel 49 is formed, in the front surface thereof, with a cam groove 50 with which a pin 52 of an inner output lever 51 fixed to the output shaft 29 is engageable. The inner output lever 51 is rotated integrally with the outer output lever 30 via the output shaft 29. A rotation of the lock motor 45 is transmitted to the lock lever 23 through the output levers 30 and 51 so as to change over the lock lever 23 between the unlocked position UL and the locked position L.

Figure 8:
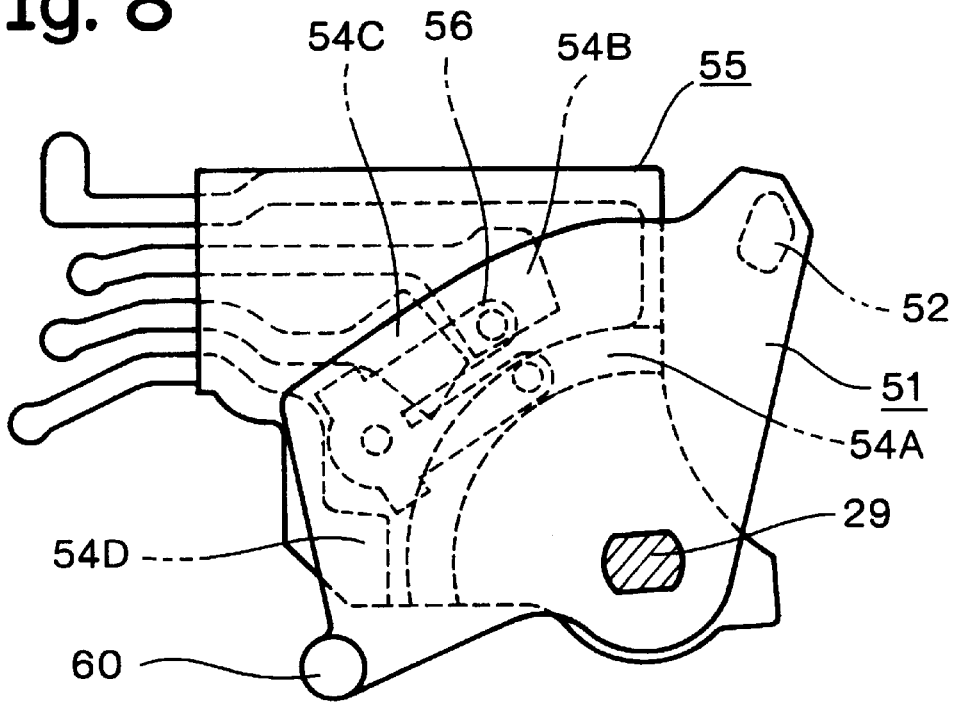
FIG. 8 is an enlarged view showing an inner output lever and substrate of the actuator.
Figure 9:
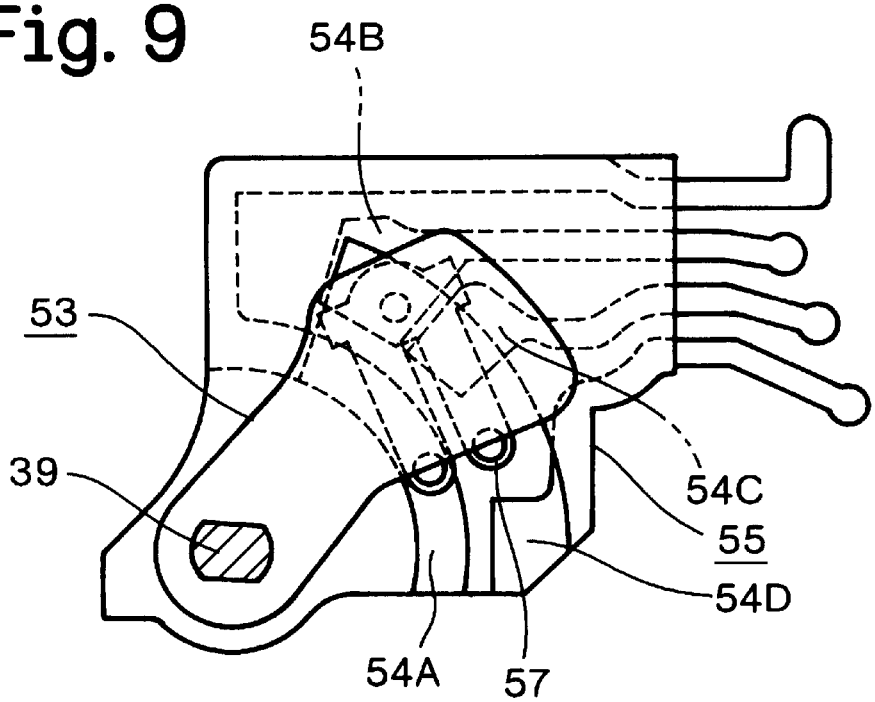
FIG. 9 is an enlarged view showing an inner input lever and the substrate of the actuator.

As shown in FIG. 7, an axis of the input shaft 39 coincides with an axis of the output shaft 29. However, both are rotated independently of each other. An inner input lever 53 located within the case 38 is fixed to an inside end of the input shaft 39. A substrate 55 having a plurality of fixed contact terminals 54A–54D (FIGS. 8, 9) are disposed between the inner input lever 53 and the inner output lever 51. A movable brush 56 is fixed on a rear surface of the output lever 51 and a movable brush 57 is fixed on the rear surface of the input lever 53. Because the inner output lever 51 is connected to the lock lever 23 without any lost-motion, a position of the lock lever 23 can be detected by cooperation of the movable brush 56 and the fixed terminals 54A, 54B. Additionally, because the inner input lever 53 is connected to the key cylinder 43 without any lost-motion, the locking and unlocking operations of the key cylinder 43 can be detected by cooperation between the movable brush 57 and the fixed terminals 54A, 54C, 54D.

In FIG. 7, an engagement lever 58 is provided leftward of the inner output lever 51. The engagement lever 58 is journaled by a shaft 59 within the case 38 and has a straight arm 58A which is formed with a slot 61 with which a protrusion 60 of the output lever 51 is slidably engaged. The engagement lever 58 further has a hook arm 58B and a contact face 58C provided at a tip end of the hook arm 58B.

The anti-theft motor 46 of the actuator 28 has a motor shaft to which a drive gear 62 is fixed. The drive gear 62 is meshed with a large-diameter gear 64 which is rotated about a shaft 63 as a center and which has a small-diameter gear 65 rotated integrally therewith. A sector gear portion 67 of a block member 66 is meshed with the small-diameter gear 65.

The block member 66 is supported by the block shaft 68 within the case 38 and is displaceable between the blocking position B and the unblocking position UB by a power of the anti-theft motor 46. The block shaft 68 is rotated integrally with the block member 66. The block member 66 further has a cancel arm 69 extended rightward and a block pin 70 formed on the cancel arm 69.

Figure 10:
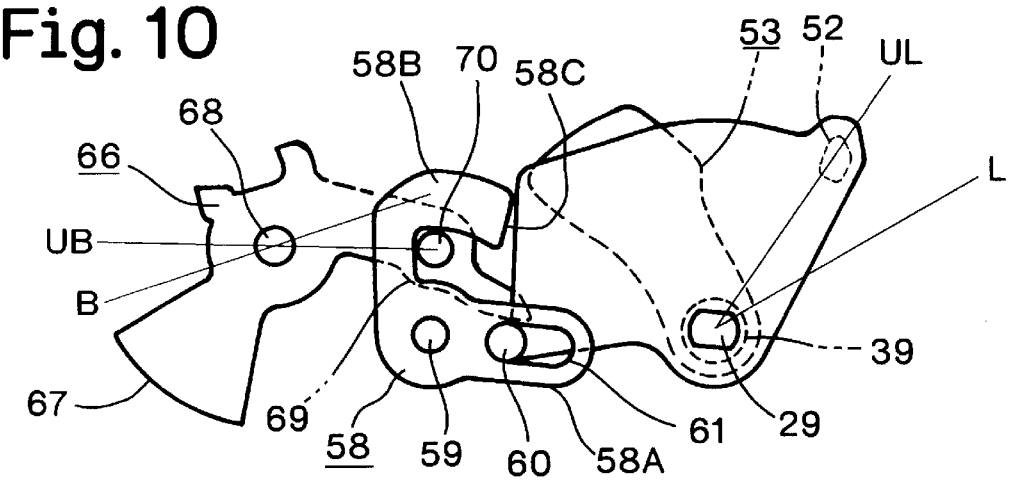
FIG. 10 is an explanatory diagram showing the unlocked state of the actuator.
Figure 11:
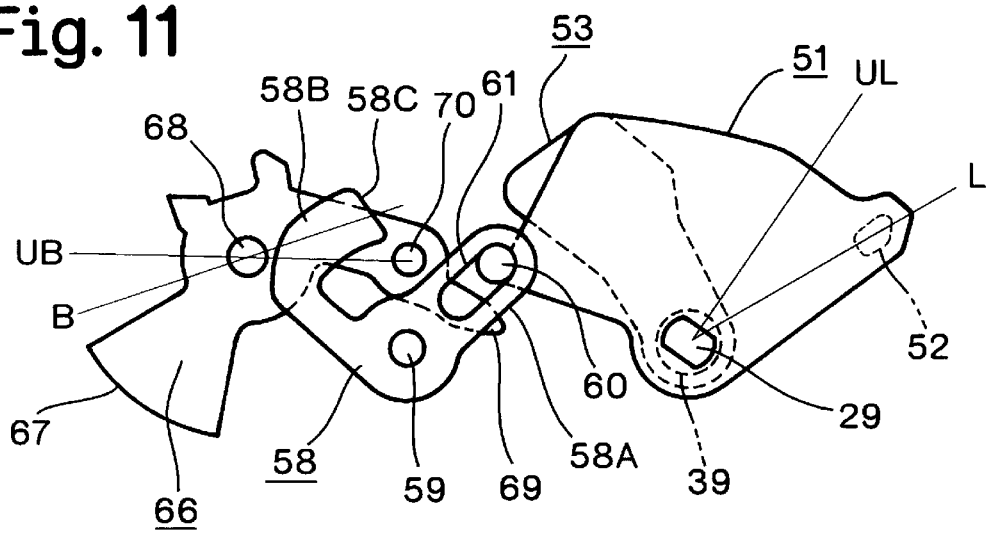
FIG. 11 is an explanatory diagram showing the locked and unblocking states of the actuator.

FIGS. 7 and 10 showing an interior of the actuator 28 in the unlocked state. In the unlocked state, the hook arm 58B of the engagement lever 58 is engageably opposed to the block pin 70 of the block member 66 in order to restrict a displacement of the block member 66 from the unblocking position UB to the blocking position B. In this unlocked state, when rotating the cam wheel 49 in the unlocking direction by the lock motor 45, the inner output lever 51 is rotated clockwise as shown in FIG. 11 so that the lock lever 23 is displaced to the locked position L. At the same time, the engagement lever 58 is rotated counterclockwise by an engagement between the protrusion 60 and slot 61 so as to release the block pin 70 from the hook arm 58B. Then, the block member 66 can be displaced from the unblocking position UB to the blocking position B.

Figure 12:
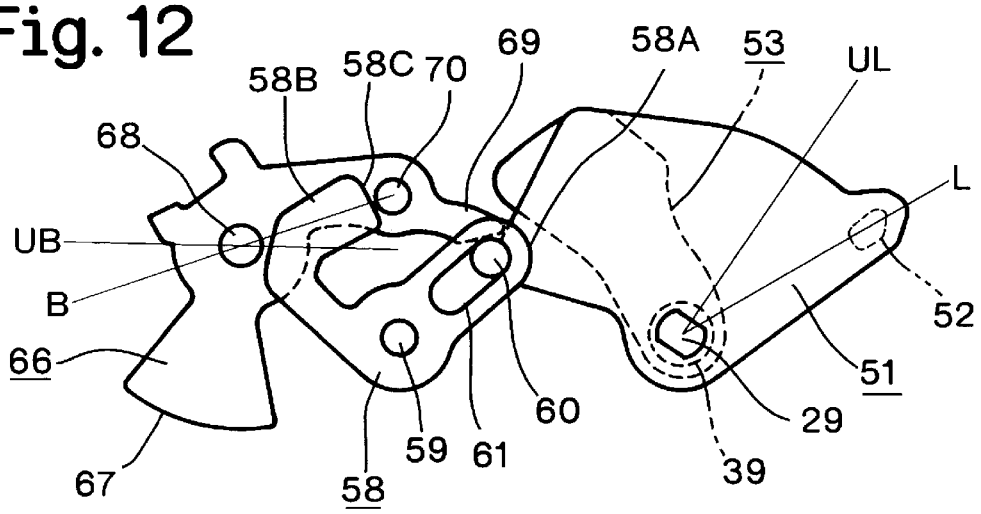
FIG. 12 is an explanatory diagram showing the blocking state of the actuator.

In the locked state of FIG. 11, when turning the block member 66 counterclockwise by power of the anti-theft motor 46 to displace the block member from the unblocking position UB to the blocking position B, the actuator 28 is changed over into the anti-theft state in which the block pin 70 is engageably opposed to the contact surface 58C of the engagement lever 58 as shown in FIG. 12. In this anti-theft state, because the clockwise rotation (unlocking rotation) of the engagement lever 58 is disabled, the unlock rotation of the lock lever 23 which is connected to the engagement lever 58 through the output levers 30, 51 without any lost-motion is also disabled. This is the block type anti-theft mechanism of this embodiment.

The anti-theft state of the actuator 28 can be cancelled by displacing the block member 66 from the blocking position B to the unblocking position UB by means of the anti-theft motor 46. Further, the anti-theft state can be also cancelled by carrying out an unlocking rotation of the door key cylinder 43 with the door key as described next.

When rotating the key cylinder 43 in the unlocking direction with the door key, the key lever 41 is rotated counterclockwise by a distance equal to a lost-motion formed between the bent piece 41A of the key lever 41 at the neutral position and the concave portion 23A of the lock lever 23 at the locked position L in FIG. 6, without moving the lock lever 23. Then, the inner input lever 53 is rotated counterclockwise in FIG. 12 through the outer input lever 40 connected to the key lever 41, and then is brought into contact with the cancel arm 69 of the block member 66 to displace the block member 66 from the blocking position B to the unblocking position UB, thereby the anti-theft state is cancelled. It should be appreciated that the block member 66 is completely protected from an illegal access without the door key. Because the block member 66 is accommodated in the case 38, and the inner input lever 53 which is connected to the door key cylinder 43 without any lost-motion is also accommodated in the case 38.

When further rotating the key cylinder 43 in the unlock direction using the door key after the block member 66 is displaced from the blocking position B to the unblocking position UB, the bent piece 41A of the key lever 41 comes into contact with the concave portion 23A of the lock lever 23 to change over the lock lever 23 from the locked position L to the unlocked position UL.

The outer protruding portion of the output shaft 29 of the actuator 28 also supports a connecting lever 72 (FIG. 15) overlapping the outer output lever 30. Although the output lever 30 is mounted fixedly on the shaft 29, the connecting lever 72 is mounted rotatably on the shaft 29. The connecting lever 72 is connected to the inside lock button 36 through a rod 71. A connecting spring 73 is provided between the connecting lever 72 and the output lever 30 as shown in FIG. 13. A first leg portion 73A of the connecting spring 73 is passed through a circular hole 72A in the connecting lever 72 and an elongated hole 30A in the output lever 30, and a second leg portion 73B of the connecting spring 73 is passed through an elongated hole 72B in the connecting lever 72 and a circular hole 30B in the output lever 30. Usually, the levers 30, 72 are rotated integrally with each other by an elastic force of the spring 73 or mechanical mutual contact therebetween via the leg portions 73A, 73B. However, when the connecting lever 72 is rotated in the unlock direction in such a condition that a rotation of the output lever 30 in the unlock direction is not allowed, only the connecting lever 72 is moved to the unlocked position UL as indicated by a phantom line of FIG. 13 while expanding the spring 73 elastically. Therefore, even if the unlocking operation by the inside lock button 36 is carried out under the anti-theft state, an unreasonable force is prevented from being applied to the output lever 30 (the lock lever 23) which cannot be moved mechanically by the block member 66.

Figure 3:
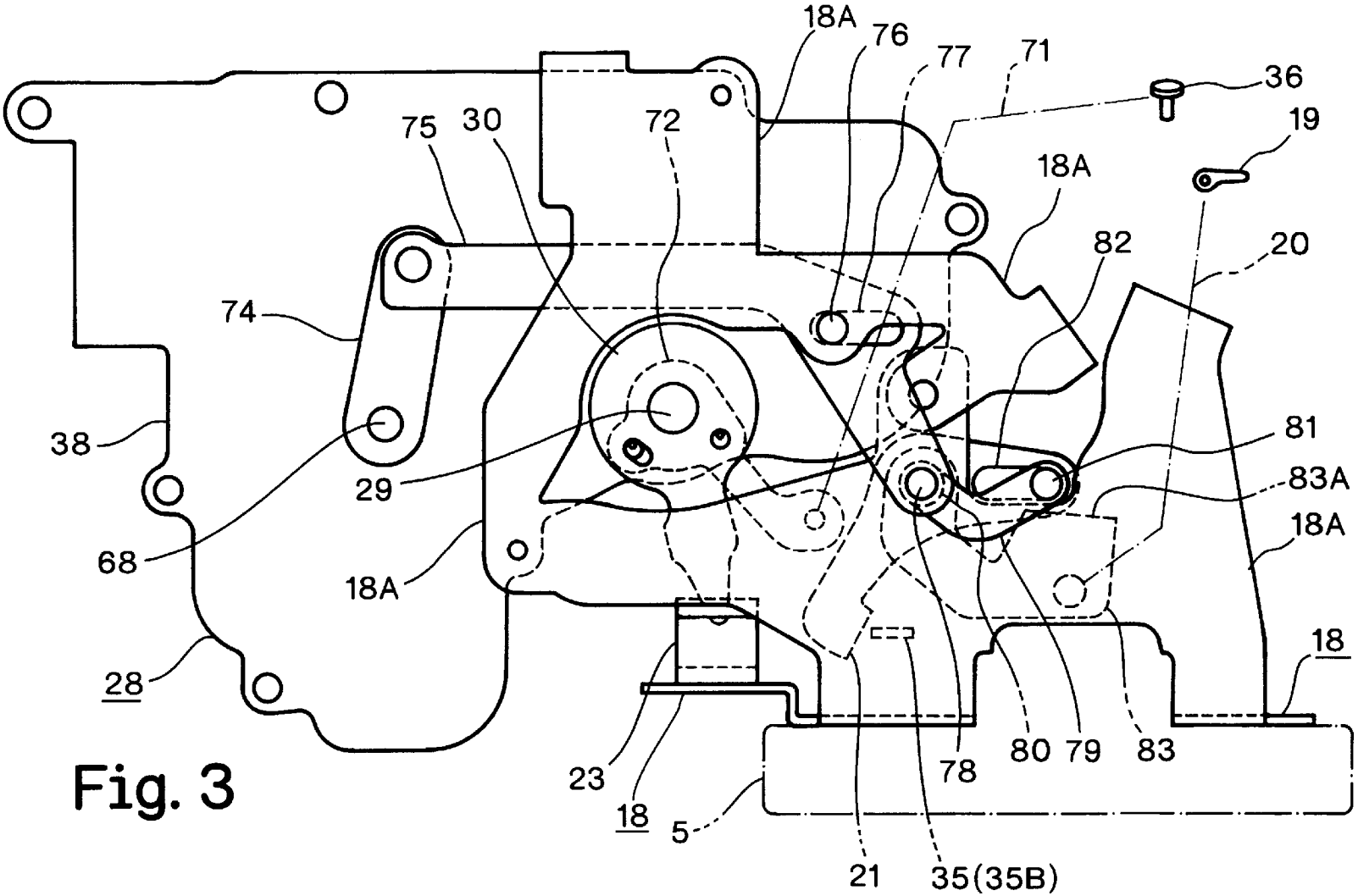
FIG. 3 is a side view showing an interior side of the latch assembly.

As shown in FIG. 3, the block shaft 68 of the actuator 28 has a protruding portion which is protruded outward through the case 38. A rotation lever 74 is fixed to the protruding portion. A long connecting link 75 has one end connected to a tip end of the rotation lever 74, and a slot 75 with which a supporting pin 76 provided on the bent plate 18A is slidably engaged. A base portion of a curved link 79 is connected to the other end of the connecting link 75 via a connecting pin 78.

Figure 4:
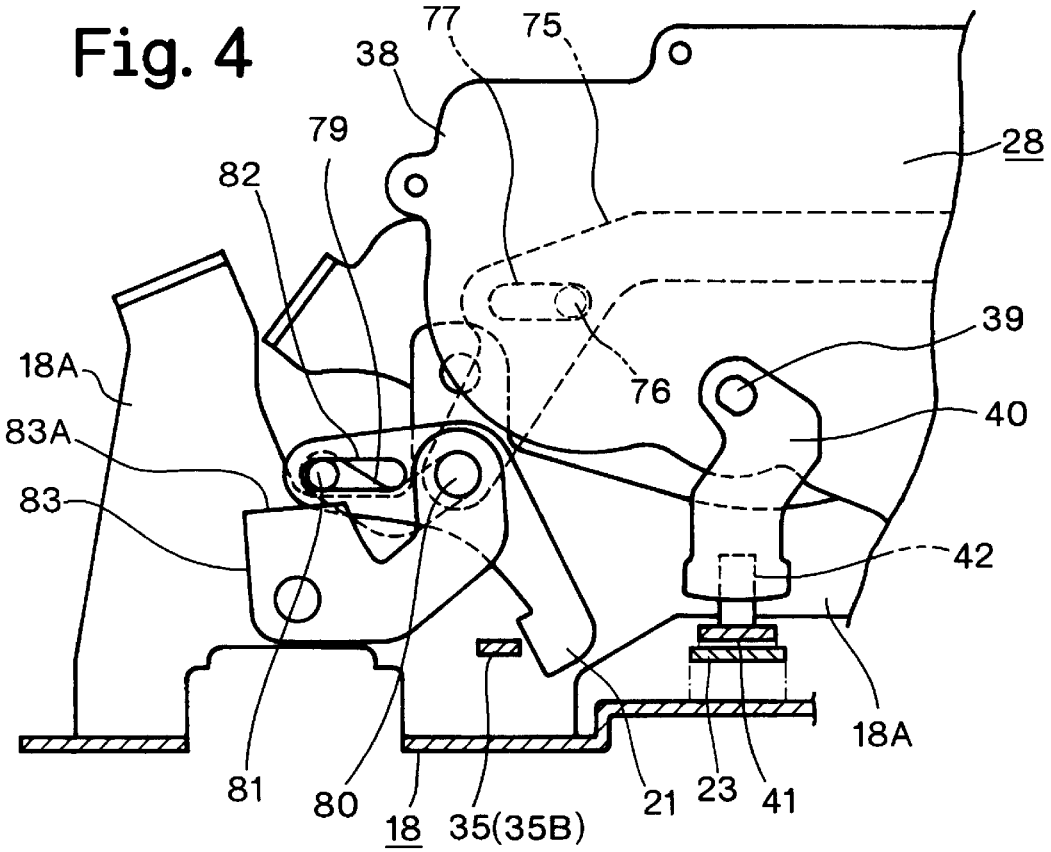
FIG. 4 is a side view showing exterior side of a bent plate of the latch assembly and parts mounted on the bent plate.

As shown FIG. 4, the inner lever 21 is journaled by a supporting shaft 80 on the bent plate 18A. The inner lever 21 has a slot 82 with which an engaging pin 81 formed at a tip end of the curved link 79 is slidably engaged. The supporting shaft 80 supports an intermediate lever 83 to which the wire 20 leading to the inside open handle 19 is connected.

The connecting link 75 is slid in the right-and-left direction in FIG. 3 by a rotation of the block shaft 68 (the block member 66) by the actuation of the anti-theft motor 46. When the block member 66 is located at the unblocking position UB, the connecting link 75 is located at a position as indicated in FIGS. 3, 4, and the engaging pin 81 of the curved link 79 is engageably opposed to a contact face 83A of the intermediate lever 83. Thus, when the door opening operation of the inside open handle 19 is performed in this state, the intermediate lever 83 makes contact with the engaging pin 81 to rotate the inner lever 21, thereby the ratchet lever 35 is rotated to open the door.

On the contrary, if the block member 66 is displaced to the blocking position B by means of the anti-theft motor 46 after the lock lever 23 is changed over to the locked position L by means of the lock motor 45, the connecting link 75 is slid leftward in FIG. 3 by a rotation of the block shaft 68, so that the engaging pin 81 of the curved link 79 is apart from the contact face 83A of the intermediate lever 83. According to the present invention, if the anti-theft mechanism is changed over to the anti-theft state, a transmission path between the inside open handle 19 and the inner lever 21 is automatically interrupted. Thus, even if the inside open handle 19 is operated to open the door under the anti-theft state, any unlocking operational force based on the one-motion door opening mechanism is never applied to the lock lever 23 which cannot be moved mechanically. Therefore, the one-motion door opening mechanism and the block type anti-theft mechanism can be adopted to the door latch device at the same time.

What is claimed is:

1. A vehicle door latch device comprising:

a latch body adapted to be mounted on a vehicle door;

a lock lever journaled on the latch body and displaceable, by an unlocking operation and a locking operation of an inside lock button of the door, between an unlocked position where it makes a door-opening operation of an outside open handle of the door effective and a locked position where it makes the door-opening operation of the outside open handle ineffective; and a block member displaceable between an unblocking position where it makes the unlocking operation of the inside lock button effective and a blocking position where it makes the unlocking operation of the inside lock button ineffective;

said block member being capable of mechanical engagement with the lock lever to restrict a displacement of the lock lever from the locked position to the unlocked position in response to the unlocking operation of the inside lock button;

wherein said device further comprises a connecting lever connected to the inside lock button with no substantial lost-motion and a connecting spring for relevantly connecting the connecting lever and the lock lever;

wherein said connecting lever is substantially displaceable integrally with the lock lever by an action of the connecting spring when the block member is located at the unblocking position;

wherein said connecting lever is displaced with respect to the lock lever against a spring force of the connecting spring when the unlocking operation of the inside lock button is carried out at a state where the block member is located at the blocking position.

2. The vehicle door latch device according to claim 1, further comprising a motorized actuator mounted on the latch body; said actuator having an output lever which is mounted on an output shaft of the actuator and which is connected to the lock lever; said connecting lever being mounted on the output shaft.

3. The vehicle door latch device according to claim 2, wherein said connecting spring connects the connecting lever and the output lever elastically.

4. A vehicle door latch device comprising:

a latch body adapted to be mounted on a vehicle door;

a lock lever journaled on the latch body and displaceable between an unlocked position where it makes a door-opening operation of an outside open handle of the door effective and a locked position where it makes the door-opening operation of the outside open handle ineffective;

a motorized actuator provided on the latch body for displacing the lock lever between the unlocked position and the locked position; and a block member displaceable between an unblocking position where it makes an unlocking operation of an inside lock button of the door effective and a blocking position where it makes the unlocking operation of the inside lock button ineffective;

said block member being capable of mechanical engagement with the lock lever to restrict a displacement of the lock lever from the locked position to the unlocked position in response to the unlocking operation of the inside lock button;

wherein said device further comprises an input lever adapted to be connected to a key cylinder of the door with no substantial lost-motion and arranged to restore the block member from the blocking position to the unblocking position;

wherein said block member and said input lever are accommodated within a housing of the actuator.

5. The vehicle door latch device according to claim 4, wherein said actuator has an output shaft and an input shaft which protrude through the housing to the outside of the actuator; said lock lever is relevantly connected to a protruding portion of the output shaft; said inner lever is connected to an inner portion of the input shaft within the housing; and a protruding portion of the input shaft is adapted to be connected to the key cylinder.

6. An actuator for a vehicle door latch device comprising:

a housing;

an inner output lever provided within the housing and displaceable between a locked position and an unlocked position;

a lock motor provided within the housing and arranged to displace the inner output lever between the locked position and the unlocked position;

a block member provided within the housing and displaceable between a blocking position where it restricts a displacement of the inner output lever from the locked position to the unlocked position by a mechanical engagement with the inner output lever and an unblocking position where it permits the displacement of the inner output lever from the locked position to the unlocked position;

an anti-theft motor provided within the housing and arranged to displace the block member between the blocking position and the unblocking position;

an inner input lever provided within the housing and arranged to restore the block member to the unblocking position by the engagement with the block member located at the blocking position when rotated;

an output shaft having an inner portion connected to the inner output lever and an outer portion protruding through the housing to the outside of the actuator; and an input shaft having an inner portion connected to the inner input lever and an outer portion protruding through the housing to the outside of the actuator.

7. A vehicle door latch device comprising:

a latch body adapted to be mounted on a vehicle door;

a lock lever journaled on the latch body and displaceable, by an unlocking operation and a locking operation of an inside lock button of the door, between an unlocked position where it makes a door-opening operation of an outside open handle of the door effective and a locked position where it makes the door-opening operation of the outside open handle ineffective;

a block member displaceable between an unblocking position where it makes the unlocking operation of the inside lock button effective and a blocking position where it makes the unlocking operation of the inside lock button ineffective;

said block member being capable of mechanical engagement with the lock lever to restrict a displacement of the lock lever from the locked position to the unlocked position in response to the unlocking operation of the inside lock button;

an one-motion door opening mechanism arranged to carry out approximately simultaneously restoration of the lock lever from the locked position to the unlocked position and opening of the door by an opening actuation of an inside open handle of the door; and a coupling means having a coupling state for transmitting the opening actuation of the inside open handle to the one-motion door opening-mechanism and an uncoupling state for not transmitting the opening actuation of the inside open handle to the one-motion door opening mechanism;

wherein said coupling means is so connected to the block member that said coupling means is displaced into the uncoupling state when said block member is displaced into the blocking position, and that said coupling means is displaced into the coupling state when said block member is displaced into the unblocking position.

8. A vehicle door latch device comprising:

a ratchet lever for opening a vehicle door when rotated;

an open lever arranged to be moved by an opening actuation of an outside open handle of the door;

a lock lever displaceable between an unlocked position for transmitting a movement of the open lever to the ratchet lever so as to rotate the ratchet lever and a locked position for not transmitting the movement of the open lever to the ratchet lever;

a block member displaceable between a blocking position where it restricts a displacement of the lock lever from the locked position to the unlocked position by a mechanical engagement with the lock lever and an unblocking position where it permits the displacement of the lock lever from the locked position to the unlocked position;

said ratchet lever being arranged to restore the lock lever to the unlocked position from the locked position when rotated;

a coupling means provided between the ratchet lever and an inside open handle of the door and having a coupling state for transmitting the opening actuation of the inside open handle to the ratchet lever and an uncoupling state for not transmitting the opening actuation of the inside open handle to the ratchet lever;

wherein said coupling means is so connected to the block member that said coupling means is displaced into the uncoupling state when said block member is displaced into the blocking position, and that said coupling means is displaced into the coupling state when said block member is displaced into the unblocking position.

* * * * *